US007603732B2

(12) United States Patent
Robles et al.

(10) Patent No.: US 7,603,732 B2
(45) Date of Patent: Oct. 20, 2009

(54) SLEEPING INFANT POSITIONING DEVICE

(76) Inventors: Veronica Robles, 13690 De Garmo Ave., Sylmar, CA (US) 91342; Norberto Robles, 13690 De Garmo Ave., Sylmar, CA (US) 91342

( * ) Notice: Subject to any disclaimer, the term of this patent is extended or adjusted under 35 U.S.C. 154(b) by 0 days.

(21) Appl. No.: 12/021,589

(22) Filed: Jan. 29, 2008

(65) Prior Publication Data

US 2009/0188046 A1 Jul. 30, 2009

(51) Int. Cl.
*A47D 15/00* (2006.01)

(52) U.S. Cl. ..... 5/655; 5/494; 128/872

(58) Field of Classification Search ..... 5/655, 5/494, 725, 496, 498; 128/872; 2/69.5
See application file for complete search history.

(56) References Cited

U.S. PATENT DOCUMENTS

| | | | | |
|---|---|---|---|---|
| RE34,763 | E * | 10/1994 | Tucker | 5/482 |
| 5,439,008 | A | 8/1995 | Bowman | |
| 5,483,711 | A | 1/1996 | Hargest et al. | |
| D382,642 | S | 8/1997 | Van Gisbergen Rutherford | |
| 5,826,287 | A | 10/1998 | Tandrup | |
| 6,631,528 | B2 | 10/2003 | Landry | |
| 6,681,422 | B2 | 1/2004 | Landry | |
| 6,708,356 | B1 | 3/2004 | LaValle | |
| 6,817,048 | B1 | 11/2004 | LaRosa | |
| 2005/0210592 | A1 | 9/2005 | Littlehorn et al. | |
| 2007/0061968 | A1 | 3/2007 | Fader | |
| 2008/0184486 | A1 * | 8/2008 | Byrne et al. | 5/494 |

* cited by examiner

*Primary Examiner*—Peter M Cuomo
*Assistant Examiner*—Brittany M Wilson
(74) *Attorney, Agent, or Firm*—Crossley Patent Law; Mark A. Crossley

(57) ABSTRACT

A sleeping infant positioning device that will hold an infant in the recommended back-lying position while in a crib or other flat surface. The device includes a pad that has an attached fabric and strap safety restraint, into which the infant is placed. The restraint is designed to fit over roughly the area where a pair of diapers would fit over the infant, with the restraint also including a pair of leg holes to allow insertion of the legs of the infant. A pouch is located on the pad behind where the infant's head is placed, allowing placement of a pillow if desired. An adjustable blanket can also be clipped to the pad, allowing the blanket to be placed over the infant if necessary.

1 Claim, 4 Drawing Sheets

SLEEPING INFANT POSITIONING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved sleeping infant positioning device that will hold an infant in the recommended back-lying position while in a crib or other flat surface.

SUMMARY OF THE INVENTION

The present invention concerns that of a new and improved sleeping infant positioning device that will hold an infant in the recommended back-lying position while in a crib or other flat surface. The device includes a pad that has an attached fabric and strap safety restraint, into which the infant is placed. The restraint is designed to fit over roughly the area where a pair of diapers would fit over the infant, with the restraint also including a pair of leg holes to allow insertion of the legs of the infant. A pouch is located on the pad behind where the infant's head is placed, allowing placement of a pillow if desired. An adjustable blanket can also be clipped to the pad, allowing the blanket to be placed over the infant if necessary.

There has thus been outlined, rather broadly, the more important features of a sleeping infant positioning device that the detailed description thereof that follows may be better understood and in order that the present contribution to the art may be better appreciated. There are, of course, additional features of the sleeping infant positioning device that will be described hereinafter and which will form the subject matter of the claims appended hereto.

In this respect, before explaining at least one embodiment of the sleeping infant positioning device in detail, it is to be understood that the sleeping infant positioning device is not limited in its application to the details of construction and to the arrangements of the components set forth in the following description or illustrated in the drawings. The sleeping infant positioning device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present sleeping infant positioning device. It is important, therefore, that the claims be regarded as including such equivalent constructions insofar as they do not depart from the spirit and scope of the present invention.

It is therefore an object of the present invention to provide a sleeping infant positioning device which has all of the advantages of the prior art and none of the disadvantages.

It is another object of the present invention to provide a sleeping infant positioning device which may be easily and efficiently manufactured and marketed.

It is another object of the present invention to provide a sleeping infant positioning device which is of durable and reliable construction.

It is yet another object of the present invention to provide a sleeping infant positioning device which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
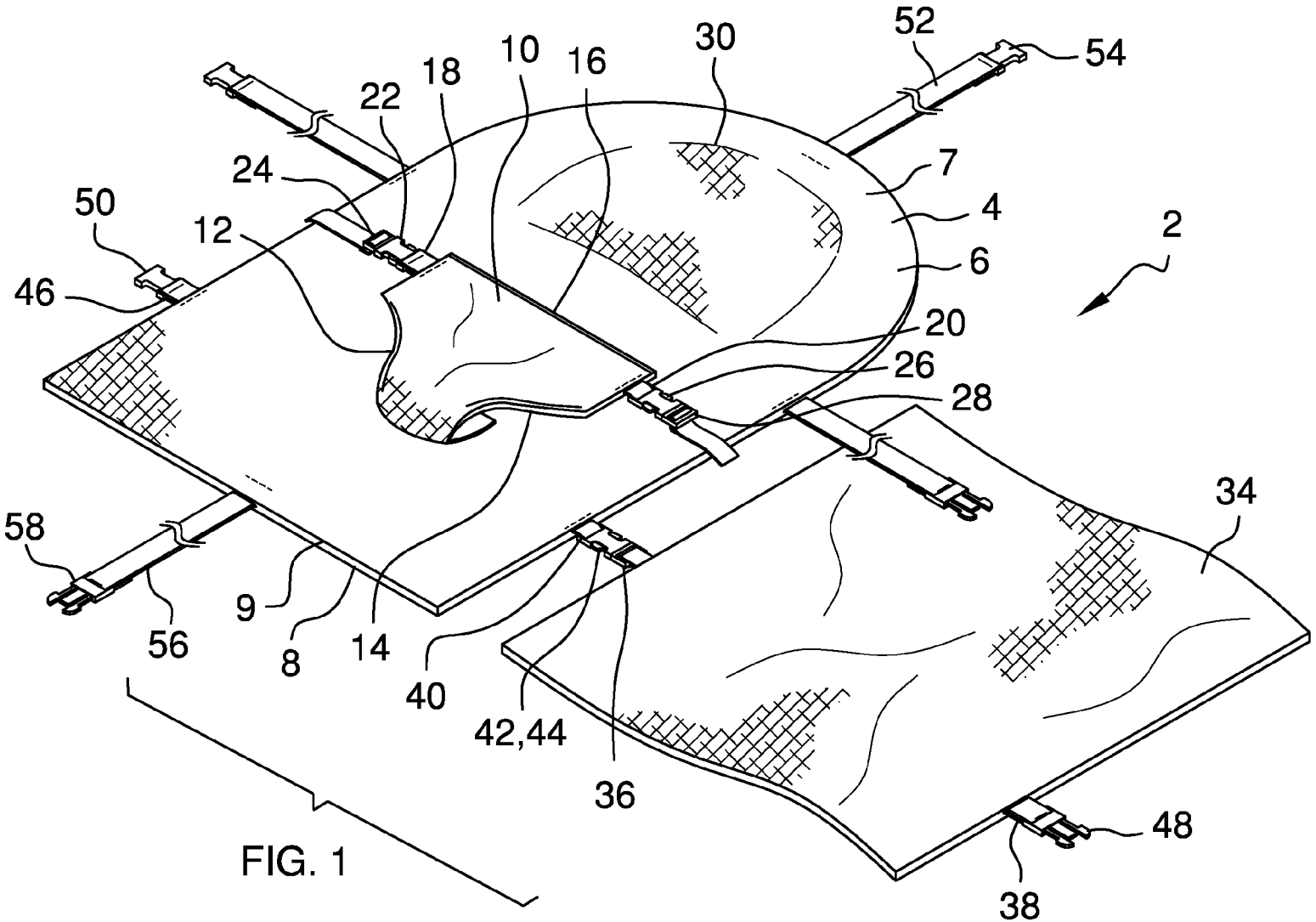
FIG. 1 shows a perspective view of the sleeping infant positioning device.
Figure 2:
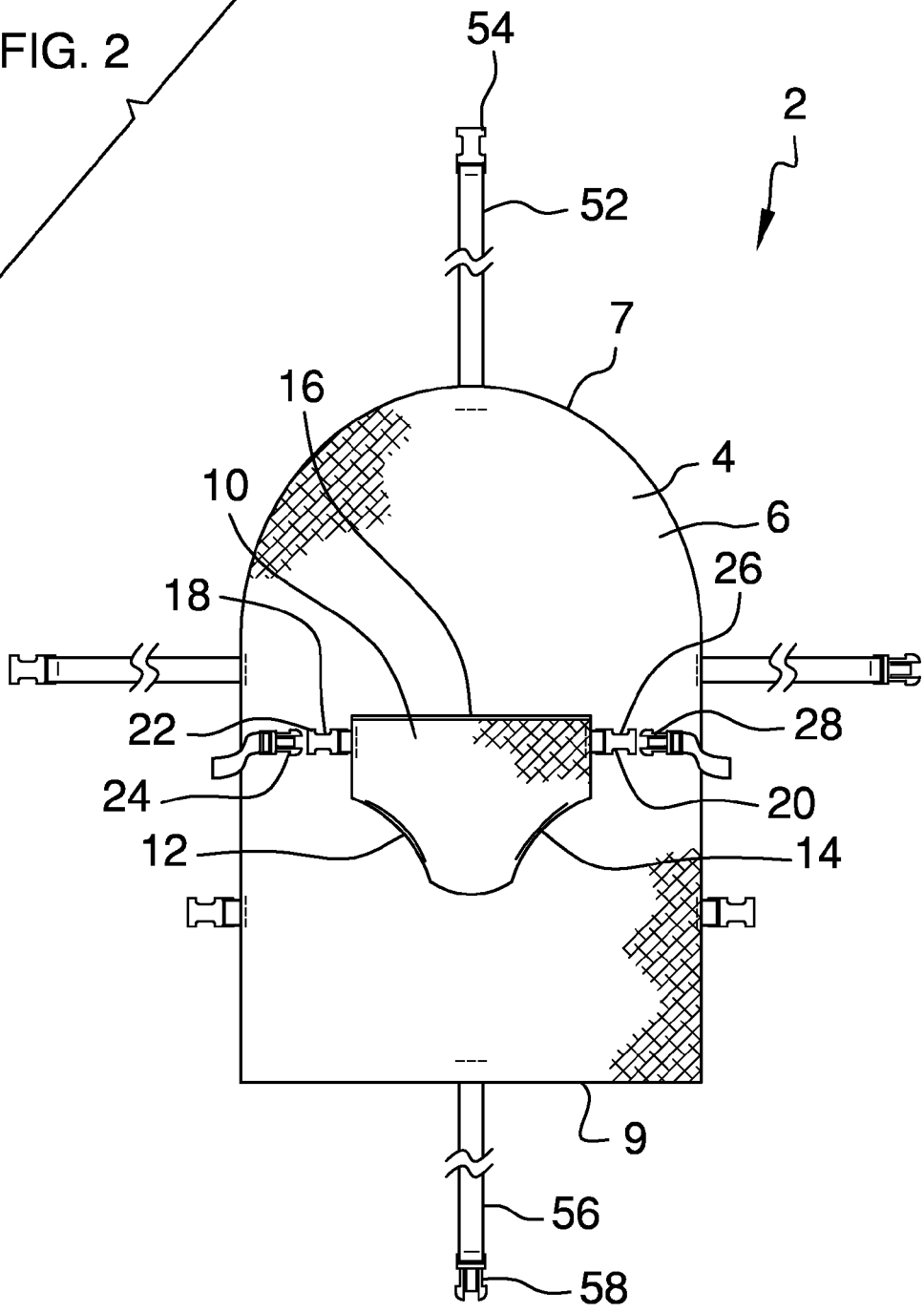
FIG. 2 shows a top view of the pad of the sleeping infant positioning device.
Figure 3:
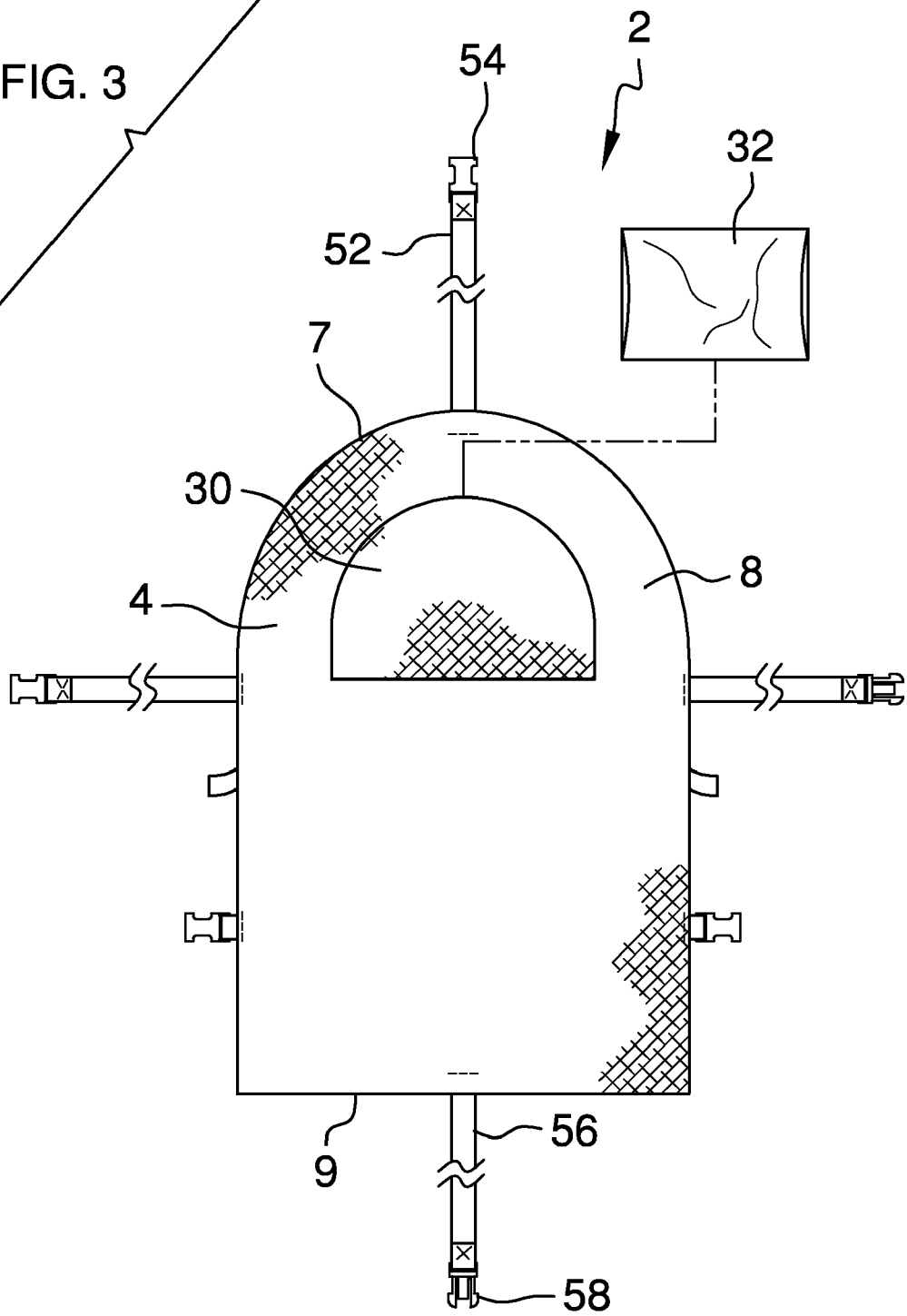
FIG. 3 shows a bottom view of the pad of the sleeping infant positioning device.
Figure 4:
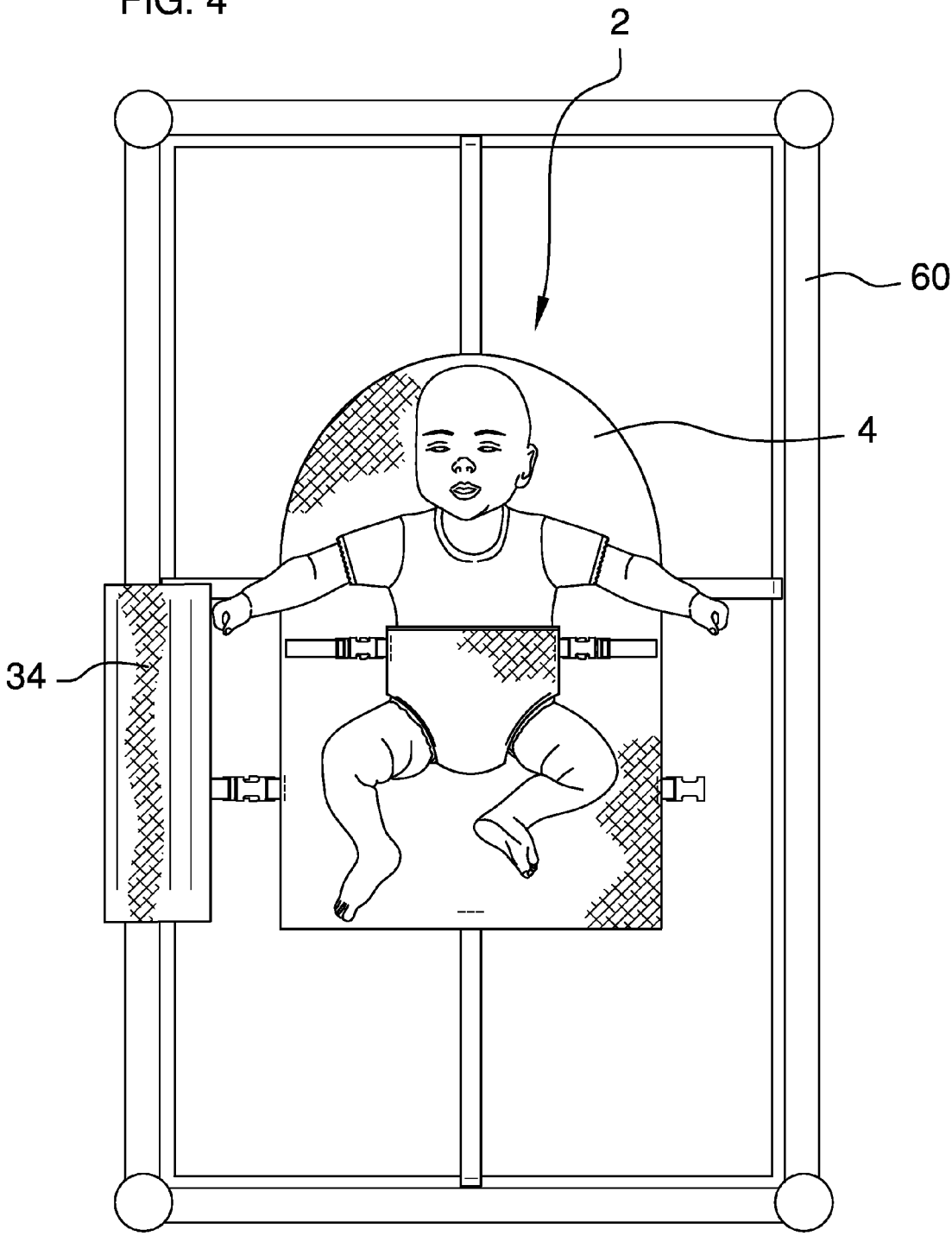
FIG. 4 shows a top view of the pad of the sleeping infant positioning device as it would appear in use.

With reference now to the drawings, and in particular to FIGS. 1 through 4 thereof, a new sleeping infant positioning device embodying the principles and concepts of the present invention and generally designated by the reference numeral 2 will be described.

As best illustrated in FIGS. 1 through 4, the sleeping infant positioning device 2 comprises a pad 4 that has two surfaces comprising an upper surface 6 and a lower surface 8. The pad 4 also has a top end 7 and a bottom end 9. The top end 7 of the pad 4 is preferably rounded, while the bottom end 9 is preferably straight-edged.

The upper surface 6 of the pad 4 has a centrally-located fabric and strap safety restraint 10, with the restraint having the approximate shape and configuration of a pair of diapers. The restraint has a pair of leg holes 12 and 14 and a top opening 16, allowing the infant to be placed within the restraint 10.

The restraint 10 itself is attached to the pad 4 by a pair of straps 18 and 20. Strap 18 is attached to the pad 4 via clamp 22 to clamp 24, which is attached to the pad 4, while strap 20 is attached to the pad 4 via clamp 26 to clamp 28, which is attached to the pad 4.

The pad 4 also has a pillow pouch 30 attached to the lower surface 8 of the pad 4 near the top end 7 of the pad 4. Into this pillow pouch 30 can be placed a pillow 32, if a caregiver so desires. The pillow pouch 30 and pillow 32 are positioned to prevent an infant located within the device 2 from being able to grasp the pillow 32.

A blanket 34 is also associated with the device 2 and can be removably attached to the pad 2 through a pair of straps 36 and 38, which are both connected to the blanket 34. Strap 36 removably connects to strap 40 on the pad 4 through clamps 42 and 44, respectively, while strap 38 is removably attached to strap 46 through clamps 48 and 50, respectively. When both straps 36 and 38 of the blanket 34 are attached to the pad 4 and the blanket 34 is located over an infant located on the pad 4, the blanket 34 is conveniently located so that it does not extend beyond the height of the infant's chest. Furthermore, because the blanket 34 is attached to the pad 2 at two different locations, the blanket 34 is not capable of being accidentally pulled up so that it is located on top of the infant's head.

Device 2 also includes a top strap 52, which is attached to the top end 7 of the pad 4 and includes clamp 54, along with bottom strap 56, which is attached to the bottom end 9 of the pad 4 and includes clamp 58. Top strap 52 and bottom strap 56 are designed to allow the pad 4 to be attached to the edges of a crib 60, thereby allowing the pad 4 to be securely fastened in place and not be capable of being moved by a continually shifting infant using the device 2.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What we claim as our invention is:

1. A sleeping infant positioning device comprising (a) a pad, the pad having two surfaces comprising an upper surface and a lower surface, the pad also having two ends comprising a top end and a bottom end, (b) means for restraining an infant onto the pad, said means further comprising (i) a restraint associated with the upper surface of the pad, (ii) a top opening located within the restraint, (iii) a pair of leg holes comprising a first leg hole and a second leg hole, the pair of leg holes being located within the restraint, and (iv) means for attaching the restraint to the upper surface of the pad, said means further comprising (1) a pair of straps comprising a first strap and a second strap, wherein the first strap and second strap are each attached to the pad, (2) a first pair of clamps comprising a first clamp and a second clamp, wherein the first clamp of the first pair of clamps is attached to the first strap, further wherein the second clamp of the first pair of claims is attached to the second strap, (3) a second pair of clamps comprising a first clamp and a second clamp, wherein the first clamp of the second pair of clamps is attached to the pad, further wherein the second clamp of the second pair of claims is attached to the pad, (4) wherein the first clamp of the first pair of clamps is attached to the first clamp of the second pair of clamps, (5) wherein the second clamp of the first pair of clamps is attached to the second clamp of the second pair of clamps, (c) means for storing a pillow within the pad, said means further comprising (i) a pillow pouch attached to the lower surface of the pad near the top end of the pad, (ii) a pillow, (iii) wherein the pillow is inserted into the pillow pouch, and (d) means for covering up an infant that is located within the device, said means further comprising (i) a blanket, (ii) means for removably connecting the blanket to the pad, said means further comprising (1) a first set of straps comprising a first strap and a second strap, the first strap and second strap of the first set of straps being connected to the blanket, (2) a second set of straps comprising a first strap and a second strap, the first strap and second strap of the second set of straps being connected to the pad wherein the first and second sets of straps are respectively connected to the opposed side edges of said blanket and said pad, (3) a first set of clamps comprising a first clamp and a second clamp, the first clamp of the first set of clamps being connected to the first strap of the first set of straps, the second clamp of the first set of clamps being connected to the first strap of the second set of straps, (4) a second set of clamps comprising a first clamp and a second clamp, the first clamp of the second set of clamps being connected to the second strap of the second set of straps, the second clamp of the second set of clamps being connected to the second strap of the second set of straps, (5) wherein the first clamp of the first set of clamps is removably attached to the first clamp of the second set of clamps, (6) further wherein the second clamp of the first set of clamps is removably attached to the second clamp of the second set of clamps, (e) means for attaching the device to a crib, said means further comprising (i) a top strap attached to the top end of the pad, (ii) a bottom strap attached to the bottom end of the pad, (iii) a first clamp located on the top strap, (iv) a second clamp located on the bottom strap, (v) wherein the top strap is attached to the crib, (vi) further wherein the bottom strap is attached to the crib.

* * * * *